United States Patent [19]

Brenner

[11] Patent Number: 4,577,441

[45] Date of Patent: Mar. 25, 1986

[54] MULTIPLE-STATION CENTRIFUGAL BLASTING APPARATUS

[75] Inventor: Peter Brenner, Schaffhausen, Switzerland

[73] Assignee: Georg Fischer Aktiengesellschaft, Scaffhausen, Switzerland

[21] Appl. No.: 588,145

[22] Filed: Mar. 9, 1984

[30] Foreign Application Priority Data

Mar. 21, 1983 [CH] Switzerland ..... 1519/83

[51] Int. Cl.[4] ..... B24C 3/18

[52] U.S. Cl. ..... 51/419; 51/424; 51/426

[58] Field of Search ..... 51/417, 423, 419, 420, 51/424, 426, 425, 164.1, 410; 134/79, 153, 155; 241/40, 171

[56] References Cited

U.S. PATENT DOCUMENTS 4,121,387 10/1978 Weis et al. ..... 51/419

4,355,490 10/1982 Lepere et al. ..... 51/419

*Primary Examiner*—Frederick R. Schmidt

*Assistant Examiner*—Robert A. Rose

*Attorney, Agent, or Firm*—Toren, McGeady, Stanger, Goldberg & Kiel

[57] ABSTRACT

A rotatable drum having a plurality of receiving stations for loading workpieces to be processed is rotated about a horizontal central axis through a plurality of work stations including at least one blasting station and a loading and unloading station. Each receiving chamber forms a sealed blasting chamber in the area of the blasting process station and flow off of the blasting medium and the blasted particles occurs by an arrangement of flow off channels defined between each of the receiving chambers and connected with the chambers in a labyrinthine manner in the central area of the drum.

10 Claims, 2 Drawing Figures

MULTIPLE-STATION CENTRIFUGAL BLASTING APPARATUS

The present invention relates generally to workpiece processing apparatus and more particularly to a multiple station centrifugal blasting machine wherein workpieces are placed within receiving chambers of a rotating drum and moved through processing stations during operation of the apparatus or machine.

A machine of the type to which the present invention relates is known in the prior art for example from U.S. Pat. No. 4,355,490 and in this machine flow off discharge or drainage of the blasting medium which is utilized for process blasting of workpieces and of particles which are blasted off the workpieces is not possible in every position of the workpiece receiving chambers of the machine. For this reason, in prior art machines of this type, two blasting stations are arranged in the lower area thereof. However, in this arrangement no blasting medium or other particles can flow off during tumbling of the workpieces which is effected in the loading and unloading stations of the equipment.

Additionally, it is disadvantageous in that the loading and unloading stations arranged above will require a high construction cost and expensive loading devices in that the cycle or phase time is determined by the sum of the tumbling, unloading and loading times and in that different holding devices are required for the various kinds of workpieces because of the frontal face support or holding of the workpieces or the machine is not universal enough.

Accordingly, the present invention is directed toward provision of a multiple station centrifugal blasting machine of the type discussed above wherein, despite compact construction and shorter processing times for the workpieces, there may be ensured a flow off of the blasting medium and of the blasted particles from each of the workpiece receiving chambers in each position of the apparatus so that there may be selected desirable positioning of the blasting process station or stations and of the loading and unloading stations.

Additionally, the workpiece holding devices are constructed in such a manner that workpieces of various shapes and sizes can be securely supported within the receiving chambers without requiring specialized holding equipment in such a manner that abrasive blasting processes will be ensured on all sides.

SUMMARY OF THE INVENTION

Briefly, the present invention may be described as blasting apparatus for passing workpieces through a plurality of process stations comprising a drum having a generally cylindrical configuration defining a plurality of receiving chambers each adapted to receive therein workpieces to be processed, means for rotating said drum about a central axis thereof for passing said receiving chambers through a plurality of process stations including at least one blasting process station and a loading and unloading station, said blasting process station including means for directing a blasting medium at said workpieces within said receiving chambers and means defining in said drum between each of said receiving chambers thereof flow off channels extending radially of said drum for enabling outflow of said blasting medium, said flow off channels being connected with said receiving chambers in a labyrinthine manner in the central area of said drum.

As a result of the apparatus of the invention it will be ensured during processing of the workpieces that the blasting medium and the particles blasted from the workpieces can flow off from each receiving chamber and in any position of the chamber.

Thus, desirable positioning for each station, such as for example the blasting, tumbling and loading and unloading stations may thereby be arranged without difficulty thereby making it possible to provide a construction which is compact and easier to load.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there is illustrated and described a preferred embodiment of the invention.

DETAILED DESCRIPTION OF THE PREFERRED EMBODIMENT

Figure 1:
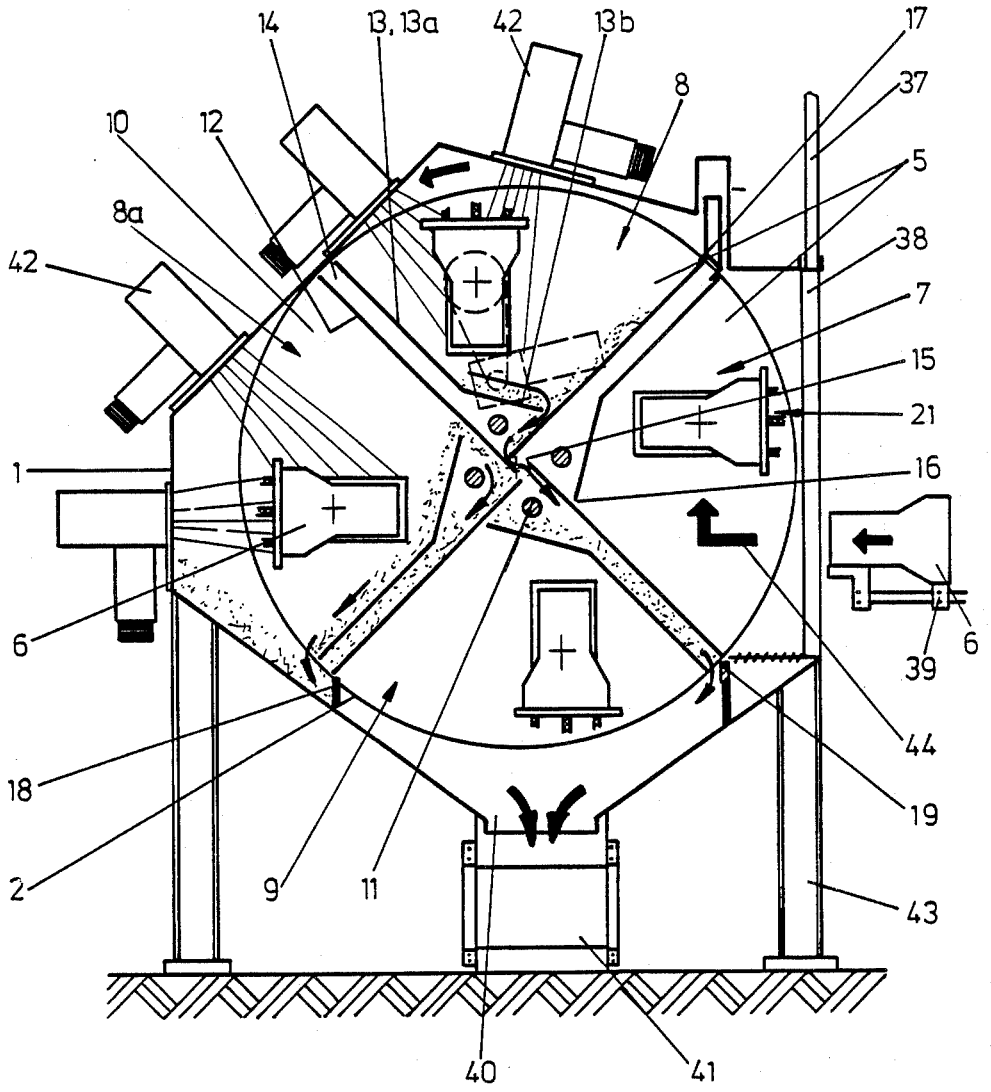
FIG. 1 is a schematic sectional view taken through the housing of a multiple station blasting process machine in accordance with the invention.
Figure 2:
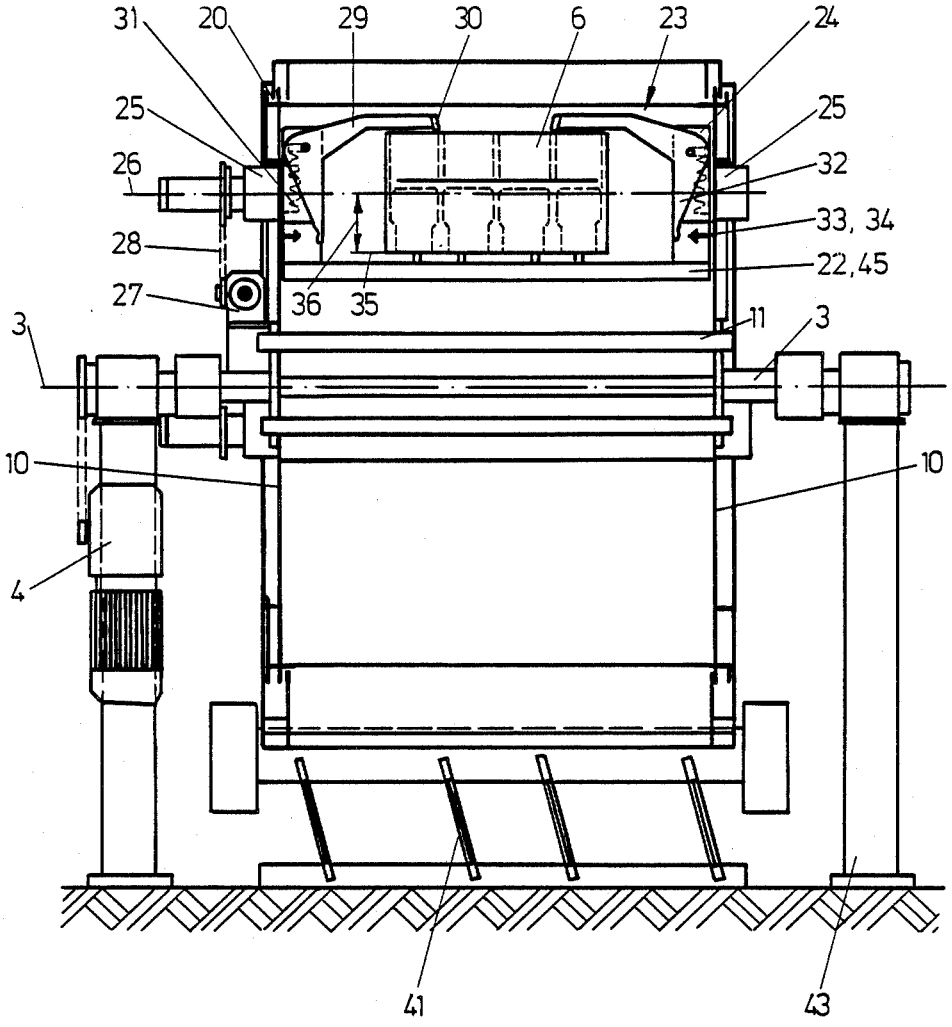
FIG. 2 is a schematic longitudinal sectional view of the apparatus of FIG. 1.

Referring now to the drawings, there is shown blasting apparatus in accordance with the present invention which essentially comprises a multiple station blasting process machine including a blasting housing 1 wherein a drum conveyor 2 is arranged to as to be rotatable about a horizontal axis 3. The drum 2 is rotatably driven by means of a geared motor 4 and the drum is arranged to define four receiving chambers 5 which are uniformly distributed about the circumference of the drum 2. Each of the receiving chambers 5 is adapted to receive workpieces 6 which can be introduced in a stepwise manner cyclically through a loading and unloading station 7. The drum 2 is rotatable so that the receiving chambers 5 may be moved through a plurality of processing stations including the loading and unloading station 7, two blasting process stations 8 and **8*a* and a tumbling station 9 defined within the blasting housing 1**.

The drum 2 is provided with side walls 10 which are connected with one another by means of bars 11 at both ends of the drum with the side walls forming the receiving chambers 5 together with dividing walls 12 and 13 arranged to extend approximately radially of the drum 2. The dividing walls 12 and 13 are arranged at a distance from one another between the receiving chambers 5 and they are configured to form blasting medium flow off channels 14 which are open at both ends.

The dividing walls 12 extend from the outer circumference of the drum to the central area of the drum 2 at a lateral distance from the drum center where they form openings 15 in that they reciprocally overlap. The dividing walls 13 extend to include an outer dividing wall part **13*a* which is parallel to the dividing wall 12 and which has an angled or bent inner dividing wall part 13*b* extending past the bars 11 and running into or toward the next consecutive dividing wall 12 wherein this part forms an opening 16 there with the next consecutive dividing wall 12**.

Accordingly, the dividing walls 12 and 13 are arranged in the central area of the drum so as to reciprocally overlap wherein the openings 15 and 16 produce a labyrinthine connection of all of the receiving chambers 5 and blasting medium flow off channels 14.

At the blasting housing 1 there are arranged sealing elements 17, 18, 19 which are preferably constructed as sealing strips which will ensure sealing of the blasting stations 8, 8*a* relative to the loading and unloading station 7 and to the tumbling station 9 as well as a sealing of the latter relative to the loading and unloading station.

Labyrinth seals 20 are also arranged between the rotating side walls 10 and the blasting housing 1 thereby creating together with the other seals and the dividing walls in the area of the blasting station sealed blasting chambers.

Each of the receiving chambers 5 has located therein a holding device 21 for holding and supporting in the receiving chambers 5 the workpieces 6. The holding devices 21 are provided with a workpiece support 22 and with at least one and preferably two clamping or tensioning devices 23.

The workpiece support 22 is fastened on both sides at a bearing part 24 with the bearing parts 24 being supported so as to be rotatable about a rotational axis 26 in bearings 25 arranged in each of the two side walls 10.

Each of the holding devices 21 is driven by means of a geared motor 27 which is fastened at each side wall 10 and through a chain or belt drive 28 so that workpieces supported in the holding devices 21 can be rotated individually at each process station. Power for the geared motors 27 rotating with the drum 2 is transmitted preferably through slip rings.

Each of the clamping devices 23 has at least one clamping claw or shoe 30 arranged at a swivel lever 29, with the swivel lever 29 being pivotally supported at a bearing part 24 and being urged into engagement with the workpiece by means of an urging device such as a spring 31. The swivel lever 29 includes a second lever arm 32 at which an actuating device 34 engages in the loading and unloading station 7 in a direction indicated by the arrow 33 in order to raise the clamping claw from the workpiece 6. The actuating device for urging the swivel lever 29 may be a ram which is electromechanically actuated or hydraulically or pneumatically actuated.

The workpiece support 22 is configured in the form of a grate or grill 45 and is fastened at the two bearing parts 24 so as to be readily exchangeable and/or vertically adjustable whereby as a result of this adjustability the distance 36 from a support plane 35 to the rotational axis 26 may be adjusted. For flat workpieces in particular, it is necessary to raise the grating so that these flat workpieces can be clamped to some extent so as to be centered relative to the rotational axis 26 for the purpose of uniform blasting procedures.

The loading and unloading station includes an opening 38 which is adapted to be closed by means of a door 37 adapted to be raised and lowered, with the opening 38 being adapted to have workpieces 6 loaded or removed therethrough, respectively, by means of a loading device 39.

For this purpose, the holding device 21 is positioned at a particular location and the workpieces 6 are fed thereto in a direction indicated by the arrow 44.

The lower part of the blasting housing 1 has an opening 40 beneath which there is arranged a vibrator conveyor 41 for carrying away blasting medium and blasted particles.

Centrifugal blasting units 42 are fastened at the circumferential walls of the blasting housing 1 and two or more of these units 42 are preferably arranged at each blasting process station 8 and 8*a*, respectively.

The blasting housing 1 is fastened at a frame 43 upon which the axis or axle 3 of the drum 2 is also rotatably supported and at which the geared motor 4 is fastened.

In the operation of the multiple station blasting process machine in accordance with the invention described in the foregoing, one or more of the workpieces 6 are loaded in a receiving chamber 5 through the opening 8 at the loading and unloading station 7 by means of the loading device 35. The workpieces are securely held in the receiving chambers 5 by the holding devices 21 through operation of the spring force provided by the spring 31 and as a result they are maintained supported on the grating 45 by means of the clamping claws 30.

The drum 2 is then rotated through an angle of 90° thereby allowing the workpieces in the receiving chamber which have been loaded at the station 7 to reach the first blasting process station 8. At this time, the workpieces are set in rotation by turning the geared motor 27 in order that they may thereby be processed on all sides by means of the centrifugal blasting of the centrifugal wheel units 42. At the same time, the second receiving chamber 5 is brought into position at the station 7 and is loaded with workpieces 6.

After the drum 2 has been again rotated through an angle of 90°, the workpieces 6 first loaded into a receiving chamber 5 will enter the second blasting process station 8*a* and a third receiving chamber 5 may then be loaded with workpieces 6 at the station 7. When the blasting process is terminated, the drum is again rotated by 90° and the finished blasted workpieces arrive at the tumble station 9. Here they are again set in rotation in order to empty blasting medium from the workpiece cavities by means of tumbling operation.

With the drum 2 being again rotated, the cleaned workpieces will enter the loading and unloading station 7 once again where they are brought into the removal position by turning the holding device by means of a position control at the geared motor 27.

The empty loading device 39 is moved under the workpiece or workpieces and the clamping claws are released by means of rotation of the actuating device 34 whereby a workpiece arrives on the loading device 39 and is removed from the receiving chamber 5 by this loading devide 39.

During tumbling or loading and unloading in the stations 9 and 7, respectively, the other workpieces can be blast processed in stations 8, 8*a* and this is made possible by the reciprocal sealing by means of the dividing walls 12 and 13 and by the sealing effected by the seal means 17, 18, and 19.

As a result of the arrangement of the dividing walls 12 and 13 which form the channels 14 which are open at the outer circumference of the drum, and due to their labyrinthine connection with the receiving chambers 5 in the center portion of the drum 2, a flow off of the blasting medium and of the particles blasted from the blasting stations 8 and 8*a* is ensured. Also, during the blasting process flow off of blasting medium is likewise ensured so that there will be no accumulations of the material causing disturbances during operation of the machine. The material may be carried away in such a manner that it has no disturbing influence on the tumbling process or on the loading and unloading process.

By assigning a rotation drive for the workpieces in each station, different numbers of revolutions, rotational directions and stopping periods of the workpieces in the individual stations are made possible and it is also possible to retain a determined holding position in the loading and unloading station.

The arrangement of four receiving chambers with up to four workpieces each, one behind the other, results in a compact machine displaying high efficiency wherein the workpieces can also be blast processed at both end faces simultaneously.

The individual rotational drives for the workpieces, which rotational drives are protected from the blasting medium, makes it possible in each blasting process station and in the tumble station to apply different rotational movement for the workpieces which may be adapted to the form of the workpieces in order to achieve a uniform blast processing.

The multiple station blasting process machine in accordance with the invention is especially suitable for workpieces which are not adapted for treatment in drums such as, for example, engine blocks, cylinder means gear unit housings and the like.

Thus, it will be seen that the present invention provides a multiple station blasting process machine which is essentially comprised of a conveyor means constructed as a cylindrical drum 2 wherein workpieces 6 are held by means of holding devices 21 in a plurality of receiving chambers 5. The respective workpieces 6 lying in a receiving chamber 5 will be conveyed through two blasting process stations 8, 8*a* and through a tumble station 9 and then back to a loading and unloading station 7 by means of stepwise rotation of the conveyor drum 2. The receiving chambers 5 which are uniformly distributed about the circumference of the drum are enclosed by walls 10, 12 and 13 which are fastened at the drum 2 and in such a manner that together with the surrounding blasting housing 1 they form a sealed blasting chamber in the area of the blasting process stations 8, 8*a*. Flow off of the blasting medium and of particles blasted from the workpieces is ensured at all times by the arrangement of the blasting medium flow channels 14 which enable effective outflow of the blasting medium as a result of their labyrinthine connection at the center portion of the receiving chamber 5 with the channels 14 being open at the outer circumference of the drum.

While a specific embodiment of the invention has been shown and described in detail to illustrate the application of the inventive principles, it will be understood that the invention may be embodied otherwise without departing from such principles.

What is claimed is:

1. Blasting apparatus for passing workpieces through a plurality of process stations comprising:

conveyor drum means having a generally cylindrical configuration defining a plurality of receiving chambers each adapted to receive therein workpieces to be processed;

means for rotating said conveyor drum means about a central axis thereof for passing said receiving chambers through a plurality of process stations including at least one blasting process station and a loading and unloading station, said blasting process station including means for directing a blasting medium at said workpieces within said receiving chambers; and wall means extending radially between each of said receiving chambers defining in said conveyor drum means between each of said receiving chambers thereof flow off channels extending radially of said conveyor drum means from the center to the outer circumference thereof for enabling outflow of said blasting medium;

said wall means having radially innermost ends defining in a labyrinthine flow pattern at the center of said conveyor drum means flow paths through which each of said flow off channels is connected with said receiving chambers.

2. Apparatus according to claim 1 wherein said wall means comprise dividing walls which divide said receiving chambers in said conveyor drum means, said dividing walls being arranged at said central area of said drum so as to reciprocally overlap and to define thereat as parts of said flow paths openings connecting said receiving chambers with said flow off channels.

3. Apparatus according to claim 1 defining four of said process stations, including said loading and unloading station, two of said blasting process stations and a tumble station, and wherein said conveyor drum means comprises four of said receiving chambers each of which is brought in a stepwise manner from said loading and unloading station into said two blasting process stations and to said tumble station.

4. Apparatus according to claim 3 further comprising a blasting housing defining a laterally arranged closeable opening with said loading and unloading station being arranged relative to said closeable opening so as to be adapted to be horizontally loaded therethrough, said tumble station being arranged in the lower area of said blasting housing, with said two blasting stations each being arranged, respectively, opposite to one of said tumble station and said loading and unloading station.

5. Apparatus according to claim 1 further comprising workpiece holding means arranged in each of said receiving chambers, said workpiece holding means comprising a workpiece support which is supported on both sides thereof in said receiving chamber and at least one clamping claw which clamps by means of a force producing device said workpiece and is arranged at a swivel lever.

6. Apparatus according to claim 5 wherein at least one engagement surface is arranged on said swivel lever at which engagement surface an actuating device for raising said clamping claw engages at said loading and unloading station.

7. Apparatus according to claim 5 wherein said force producing device comprises a spring acting at said swivel lever.

8. Apparatus according to claim 5 wherein said holding devices are arranged to be rotatable in said receiving chamber and wherein said holding devices further comprise individual rotating drive means therefor arranged outside said receiving chambers at said conveyor drum means.

9. Apparatus according to claim 5 wherein said workpiece support comprises a grating formed from a plurality of bars defining a support plane for said workpieces, said support plane being located at a distance from the rotational axis of said workpiece holding means.

10. Apparatus according to claim 9 wherein said distance between said support plane and said rotational axis may be adjustably altered.

* * * * *